US007891805B2

(12) United States Patent
Imoto et al.

(10) Patent No.: US 7,891,805 B2
(45) Date of Patent: Feb. 22, 2011

(54) IMAGE FORMING DEVICE

(75) Inventors: Shinji Imoto, Tokyo (JP); Seiichi Kogure, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 992 days.

(21) Appl. No.: 11/663,601

(22) PCT Filed: Jun. 12, 2006

(86) PCT No.: PCT/JP2006/312199

§ 371 (c)(1),
(2), (4) Date: Mar. 23, 2007

(87) PCT Pub. No.: WO2007/013236

PCT Pub. Date: Feb. 1, 2007

(65) Prior Publication Data

US 2008/0043083 A1 Feb. 21, 2008

(30) Foreign Application Priority Data

Jul. 26, 2005 (JP) ..... 2005-216253

(51) Int. Cl.
*B41J 2/01* (2006.01)

(52) U.S. Cl. ..... 347/104; 347/101

(58) Field of Classification Search ..... 347/104, 347/103, 101, 102
See application file for complete search history.

(56) References Cited

U.S. PATENT DOCUMENTS 5,133,616 A 7/1992 Oyaide et al.
6,354,589 B1 3/2002 Taruki et al.
6,508,540 B1 * 1/2003 Lean et al. ..... 347/104
6,786,590 B2 9/2004 Maki et al.
7,621,632 B2 * 11/2009 Imoto et al. ..... 347/104
7,682,016 B2 * 3/2010 Sakuma et al. ..... 347/104
2002/0018097 A1 * 2/2002 Kitahara et al. ..... 347/42
2002/0126193 A1 9/2002 Maki et al.
2004/0263603 A1 12/2004 Maki et al.
2006/0055754 A1 3/2006 Sakuma et al.

FOREIGN PATENT DOCUMENTS

JP 1-261138 10/1989
JP 4-7235 1/1992
JP 2003-103857 4/2003

(Continued)

OTHER PUBLICATIONS

Jun. 12, 2009 European search report in connection with a counterpart European patent application No. 06 74 7320.

(Continued)

*Primary Examiner*—Manish S Shah
(74) *Attorney, Agent, or Firm*—Cooper & Dunham LLP

(57) ABSTRACT

An image forming device, includes a recording head configured to jet a liquid drop of recording liquid to a recording medium so that an image is formed; and a conveyance belt adhering the recording medium by an electrostatic force. The recording medium adhered to the conveyance belt by the electrostatic force is not separated from the conveyance belt at an angle formed by a flat surface of the conveyance belt facing the recording head and a tilt surface of the conveyance belt tilting downward at a downstream side of the recording head.

17 Claims, 11 Drawing Sheets

FOREIGN PATENT DOCUMENTS

| | | | |
|---|---|---|---|
| JP | 2004-175494 | | 6/2004 |
| JP | 2004-217332 | | 8/2004 |
| JP | 2005-145600 | | 6/2005 |
| KR | 1020050083988 | A | 8/2005 |
| WO | WO2004/048239 | A1 | 6/2004 |
| WO | WO2004/048240 | A1 | 6/2004 |

OTHER PUBLICATIONS

Sep. 11, 2008 official action in connection with a counterpart Korean patent application No. 10-2007-7006858.

Aug. 10, 2010 Japanese official action in connection with counterpart Japanese patent application.

* cited by examiner

| | ABSORBABILITY |
|---|---|
| SINGLE SIDE | 10 |
| BOTH SIDES | 5 |

FIG.12

SINGLE SIDE PRINTING

| θ1[° ] | SEPARATION ○:NO, ×:YES |
|---|---|
| 1 | ○ |
| 2 | ○ |
| 3 | ○ |
| 4 | ○ |
| 5 | ○ |
| 6 | × |
| 7 | × |
| 8 | × |
| 9 | × |
| 10 | × |

FIG.13

BOTH SIDES PRINTING

| θ1[° ] | SEPARATION ○:NO, ×:YES |
|---|---|
| 1 | ○ |
| 2 | ○ |
| 3 | ○ |
| 4 | × |
| 5 | × |
| 6 | × |
| 7 | × |
| 8 | × |
| 9 | × |
| 10 | × |

FIG.14

SINGLE SIDE PRINTING

| a[mm] | ABRASION OF HEAD ○:NO, ×:YES |
|---|---|
| 1 | × |
| ▪ | × |
| ▪ | × |
| 9 | × |
| 10 | ○ |
| 11 | ○ |
| 12 | ○ |
| 13 | ○ |
| 14 | ○ |
| ▪ | ○ |
| ▪ | ○ |

FIG.15

BOTH SIDES PRINTING

| a[mm] | ABRASION OF HEAD ○:NO, ×:YES |
|---|---|
| 1 | × |
| ▪ | × |
| ▪ | × |
| 9 | × |
| 10 | × |
| 11 | × |
| 12 | ○ |
| 13 | ○ |
| 14 | ○ |
| ▪ | ○ |
| ▪ | ○ |

IMAGE FORMING DEVICE

TECHNICAL FIELD

The present invention generally relates to image forming devices, and more specifically, to an image forming device having a conveyance belt configured to convey a recording medium.

BACKGROUND ART

An inkjet recording device, for example, is known as an image forming device such as a printer, facsimile, copier or a multiple function processing machine of the printer, facsimile, and copier. In the above-mentioned inkjet recording device, while a recording medium is conveyed, a liquid drop of recording liquid (hereinafter "ink drop") is adhered to the recording medium by using a recording head (image forming part) having a liquid jet head configured to jet the liquid drop of the recording liquid, so that image forming such as recording or printing is performed. Hereinafter, the recording medium is called a paper or transferred material. However, there is no limitation of material for the paper or the transferred material.

In the meantime, in a case where an image is formed by an ink jet recording method, ink adheres to paper. Therefore, when an image is formed on the paper, moisture included in the ink causes the paper to stretch. This phenomenon is referred to as cockling.

Cockling causes paper waviness so that the distance between the nozzle of a recording head and a paper surface varies depending on the position on the paper surface. Cockling may worsen to such an extent that, in the worst case, the paper comes into contact with the nozzle surface of the recording head.

As a result, not only the nozzle surface of the recording head but also the paper itself may be contaminated so that image quality is degraded. In addition, due to cockling, a portion in the paper where the ink drop adheres may be shifted.

In the related art inkjet recording devices, feeding of the paper is performed by using two groups of rollers arranged one group at each end of a printing area. With this structure, however, it is difficult to obtain high feeding precision unless the printing sheet is firmly in contact with both of the groups of rollers.

However, recently, a larger image forming area has become required, and in order to increase the printing area, there is proposed an inkjet image recording device having only one group of rollers for feeding the printing sheet.

However, such a device makes it even more difficult to obtain high feeding precision. Specifically, with the printing sheet being in contact with the rollers at only one side, the printing sheet floats relative to the rollers sometimes, and a force for conveying the printing sheet cannot be obtained. Consequently, the feeding precision becomes low, and the image quality declines.

Therefore, inkjet recording devices are proposed to solve this problem in which, in order to maintain flatness of the printing sheet, a charged seamless belt is provided to hold the paper on the belt by an electrostatic force due to the charge, and the belt is rolled in this state to convey the paper. In this way, floating of the paper from the belt is preventable and good flatness can be obtained.

Meanwhile, in the inkjet recording device in which the printing sheet is fed while being held on the feeding belt by an electrostatic force, the flatness of the paper is directly related to flatness of the belt.

In addition, in the above-mentioned inkjet recording device of the related art, the feeding belt is tensioned by at least two rollers and the portion of the belt between the rollers corresponds to the printing area, that is, the area printed on by the inkjet head. This portion of the belt rumples easily, and oscillates in a direction perpendicular to the belt surface when the belt is rolled, causing declination of flatness of the belt.

Thus, since generally the flatness of the printing sheet is directly related to flatness of the belt, the distance between the recording head and the printing sheet changes, causing image quality to decline.

Japanese Laid-Open Patent Application Publication No. 2004-175494 discloses an image forming device where flatness of the plane surface of a conveyance belt in an area facing the recording head can be secured. In this image forming device, the conveyance belt for conveying the paper is tensioned between a conveying roller and a tension roller, a guide member for guiding the conveyance belt is mounted on a rear face side of the part of the conveyance belt corresponding to the printing area of the recording head, and the guide member is mounted projection to the recording head side with respect to a tangent line between the rollers.

However, as discussed in Japanese Laid-Open Patent Application Publication No. 2004-175494, in a case where a plane surface state of the conveyance belt is formed due to a guide member configured to guide from a rear surface side and the paper is conveyed in a state where the paper is electrostatically adhered, the paper is separated from the conveyance belt just downstream of the plane surface formed due to the guide member.

The inventors of the present invention examined the reason for this problem and found that the conveyance belt passing over the guide member is supported so that it is tilted downward and to the roller because the upper surface of the guide member is mounted to project to the recording head side with respect to the tangent line between the rollers for securing the flatness of the conveyance belt in the area facing the recording head. As a result of this, it is found that this problem is related to the paper being easily self-stripped.

Especially, in a case where the paper is adhered to the conveyance belt by the electrostatic force, if a head end of the paper is separated from the conveyance belt, the electrostatic force does not work and the paper may be immediately separated. In addition, since the moisture is not sufficiently dried at the time when the second surface of the paper is both-sides printed, the paper including a relatively large amount of the moisture such as when set-solid printing is applied, the attraction force between the paper and the conveyance belt becomes low so that self stripping may easily happen.

Furthermore, when the ink adheres to the paper adhered by the conveyance belt, the paper may expand due to the moisture so that the paper waviness in a direction crossing the conveyance direction may be generated. When the paper is separated from the conveyance belt at the downstream side of the guide member, the paper waviness reaches back to the guide member part so that the abrasion between the recording head and the paper may happen, in which case the image receives damage.

BRIEF SUMMARY

In an aspect of this disclosure, there is provided an image forming device wherein a high quality image can be stably formed by preventing separation of a recording medium from a conveyance belt or by preventing abrasion with a recording head due to the separation.

In another aspect, there is provided an image forming device, including: a recording head configured to jet a liquid drop of recording liquid to a recording medium so that an image is formed; and a conveyance belt adhering the recording medium by an electrostatic force; wherein the recording medium adhered to the conveyance belt by the electrostatic force is not separated from the conveyance belt at an angle formed by a flat surface of the conveyance belt facing the recording head and a tilt surface of the conveyance belt tilting downward at a downstream side of the recording head.

Thus, it is possible to prevent the recording medium from being separated from the conveyance belt at a downstream side of the recording head due to self stripping and thereby it is possible to stably form the high quality image.

In another aspect, there is provided an image forming device, including: a recording head configured to jet a liquid drop of recording liquid to a recording medium so that an image is formed; and a conveyance belt adhering the recording medium by an electrostatic force; wherein a flat surface of the conveyance belt facing the recording head and a tilt surface of the conveyance belt tilting downward at a downstream side of the recording head are formed; and waviness of the recording medium does not reach to the flat surface because of a length of the tilt surface.

In the aforementioned image forming device, even if the separation of the paper is generated at a tilt surface of the conveyance belt, paper waviness does not reach to the flat surface and abrasion with the recording head is prevented. Hence, it is possible to stably form the high quality image.

In another aspect, there is provided an image forming device, including: a recording head configured to jet a liquid drop of recording liquid to a recording medium so that an image is formed; and a conveyance belt adhering the recording medium by an electrostatic force; wherein a flat surface of the conveyance belt facing the recording head and a tilt surface of the conveyance belt tilting downward at a downstream side of the recording head are formed; and a spur is provided so as to press the recording medium conveyed to a position lower than the flat surface of the conveyance belt.

Thus, it is possible to prevent the recording medium from being separated from the conveyance belt at the downstream side of the recording head and thereby it is possible to stably form the high quality image.

Other aspects, features, and advantages will become more apparent from the following detailed description when read in conjunction with the accompanying drawings.

BRIEF DESCRIPTION OF THE DRAWINGS

FIG. 12 is a table for explaining an example of the relationship between an angle θ1 in FIG. 10 and the result of measurement of separation of the paper from the conveyance belt in a single side printing mode;

FIG. 13 is a table for explaining an example of the relationship between an angle θ1 in FIG. 10 and the result of measurement of separation of the paper from the conveyance belt in a both sides printing mode;

FIG. 14 is a table for explaining an example of the relationship between a length a in FIG. 10 and the result of measurement of existence of head abrasion in the single side printing mode;

FIG. 15 is a table for explaining an example of the relationship between a length a in FIG. 10 and the result of measurement of existence of head abrasion in the both sides printing mode;

BEST MODE FOR CARRYING OUT THE INVENTION

A description of the present invention is now given, with reference to FIG. 1 through FIG. 17, including embodiments of the present invention.

First, an image forming device of an embodiment of the present invention is discussed with reference to FIG. 1 through FIG. 3.

Figure 1:
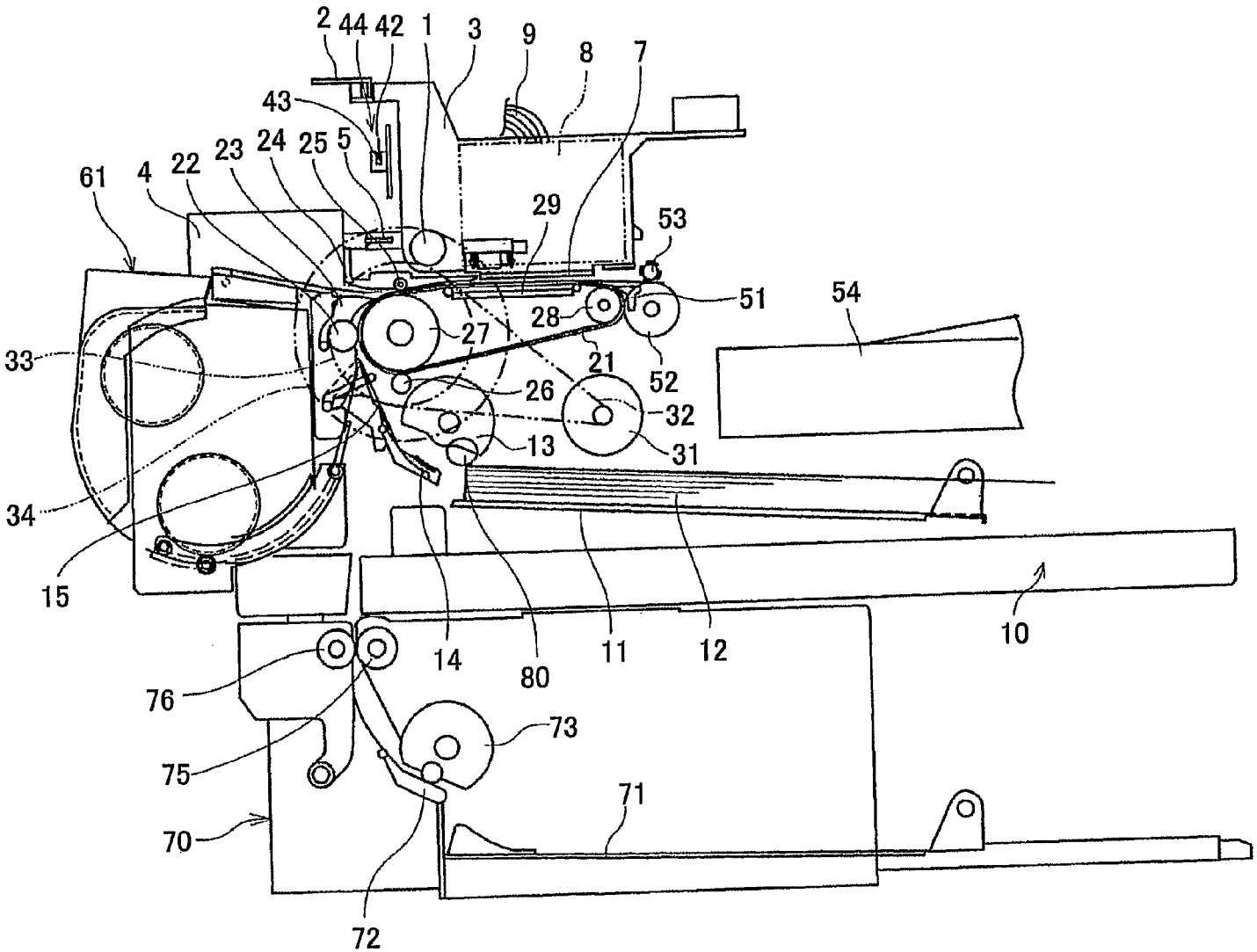
FIG. 1 is a side cut-away view of a mechanism part of an image forming device of an embodiment of the present invention.

Here, FIG. 1 is a side cut-away view of a mechanism part of an image forming device of an embodiment of the present invention. FIG. 2 is a plan view of a main part of the image forming device shown in FIG. 1. FIG. 3 is an expanded side view of the main part of the image forming device shown in FIG. 1.

Figure 2:
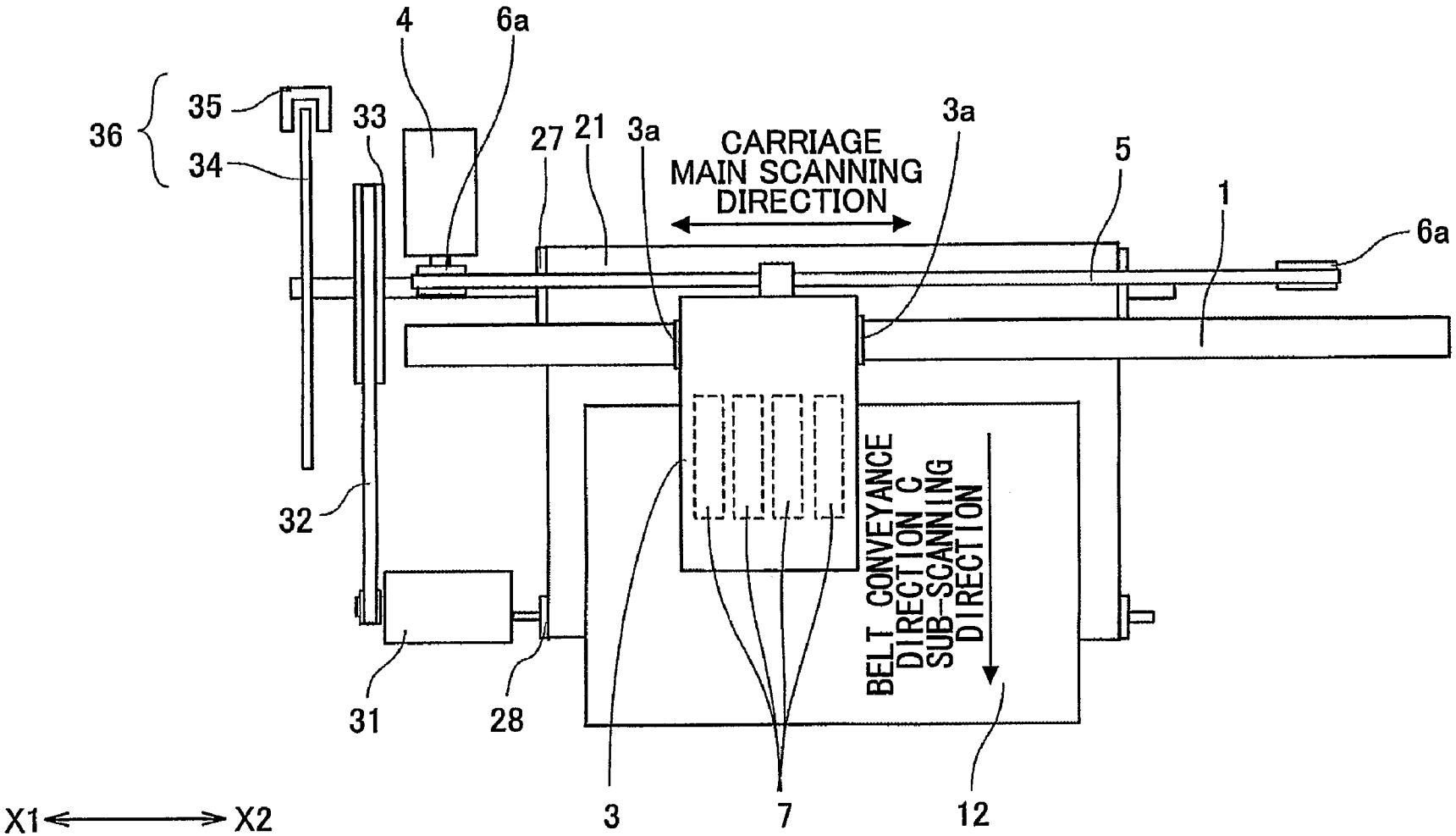
FIG. 2 is a plan view of a main part of the image forming device shown in FIG. 1.

Referring to FIG. 1 and FIG. 2, the image forming device includes a guide rod 1 and a stay 2 provided as guide members extending between side plates (not shown in the FIG. 1 and FIG. 2) on the X1 and X2 sides. The image forming device holds a carriage 3 by the guide rod 1 and the stay 2 so that the carriage 3 can slide in a main scanning direction or the X1 and X2 directions.

A main scanning motor 4 drives the carriage 3 so that the carriage 3 moves and scans in the main scanning direction shown by an arrow in FIG. 2 via a timing belt 5 provided between a driving pulley 6*a* and an idler pulley 6*b*. Guide bushings (bearings) 3*a* are provided between the carriage 3 and the guide rod 1.

The carriage 3 includes a recording head 7 composed of four ink-jet heads of yellow (Y), cyan (C), magenta (M), and black (Bk) ejecting ink droplets of respective colors. The recording head 7 is attached so that the ink ejection openings of the recording head 7 are arranged in a direction to cross the main scanning direction and ink is ejected from the ink ejection openings in the downward direction.

The ink jet head forming the recording head 7 may have a piezoelectric actuator such as a piezoelectric element, a thermal actuator which uses phase changes due to film boiling of liquid by using an electric thermal conversion element such as an exothermic resistor, a shape memory alloy actuator which uses metal phase changes based on temperature changes, or an electrostatic actuator which uses an electrostatic force, as an energy generation part configured to jet the ink (recording liquid).

The recording head 7 may be formed by a single or plural liquid drop jetting head(s) having plural nozzle lines jetting different colors.

The carriage 3 includes sub tanks 8 of the four colors for supplying the respective color inks to the recording head 7. The color inks are supplied from respective main tanks (ink cartridges, not shown in FIG. 1 and FIG. 2) through ink supply tubes 9 to the corresponding sub tanks 8.

Other than the recording head 7 jetting the link drop, a recording head configured to jet fixing process liquid (fixing ink) which reacts with the recording liquid (ink) so that a fixing ability of the ink can be improved, may be provided.

In addition, the image forming device includes a paper feeding part configured to feed papers 12 stacked on a paper stacking part (a pressure plate) 11 of a paper feeding tray 10.

The paper feeding part includes a crescent-shaped roller (a paper feeding roller) 13 that separates and feeds the papers 12 one by one from the paper stacking part 11 and a separation pad 14 formed of a material with a high coefficient of friction and provided to oppose the paper feeding roller 13. The separation pad 14 is biased toward the paper feeding roller 13.

The image forming device also includes a conveying part configured to convey each of the recording media (papers) 12 fed from the paper feeding part below of the recording head 7. The conveying part includes a conveyance belt 21, a counter roller 22, a conveying guide 23, an edge pressure roller 25, and an electrostatic charging roller 26.

The conveyance belt 21 conveys the paper 12 by causing the paper 12 to adhere electrostatically to the conveyance belt 21. The paper 12 is fed through a guide 15 from the paper feeding part to be conveyed and held between the conveyance belt 21 and the counter roller 22.

The conveying guide 23 changes the conveying direction of the sheet of paper 12 fed substantially vertically in the upward direction by substantially 90 degrees so that the paper 12 is conveyed on and along the conveyance belt 21. The edge pressure roller 25 is biased toward the conveyance belt 21 by a holding member 24. The electrostatic charging roller 26 forms a charging part that charges the surface of the conveyance belt 21.

A conveying path having an arc shaped configuration is formed between the conveying guide 23 and the conveyance belt 21 provided on the conveying roller (belt driving roller) 22 so that the direction of the paper 12 guided upward in a substantially vertical direction is changed by approximately 90 degrees. Accordingly, the surface of the conveyance path facing the conveyance belt 21 has an arc shaped configuration having a radius of curvature greater than the radius of curvature of the conveyance belt 21.

The conveyance belt 21 is an endless belt and may be formed by connecting both ends of a belt having ends. The conveyance belt 21 is tensioned between the conveying roller 27 and the tension roller 28. The sub-scanning motor 31 rotates the conveying roller 27 via the timing belt 32 and the timing roller 33 so that the conveyance belt 21 is rotated in a belt conveyance direction of FIG. 2, namely a sub-scanning direction.

A guide member 29 is provided at a rear surface side of the conveyance belt 21 corresponding to an image forming area of the recording head 7.

Figure 4:
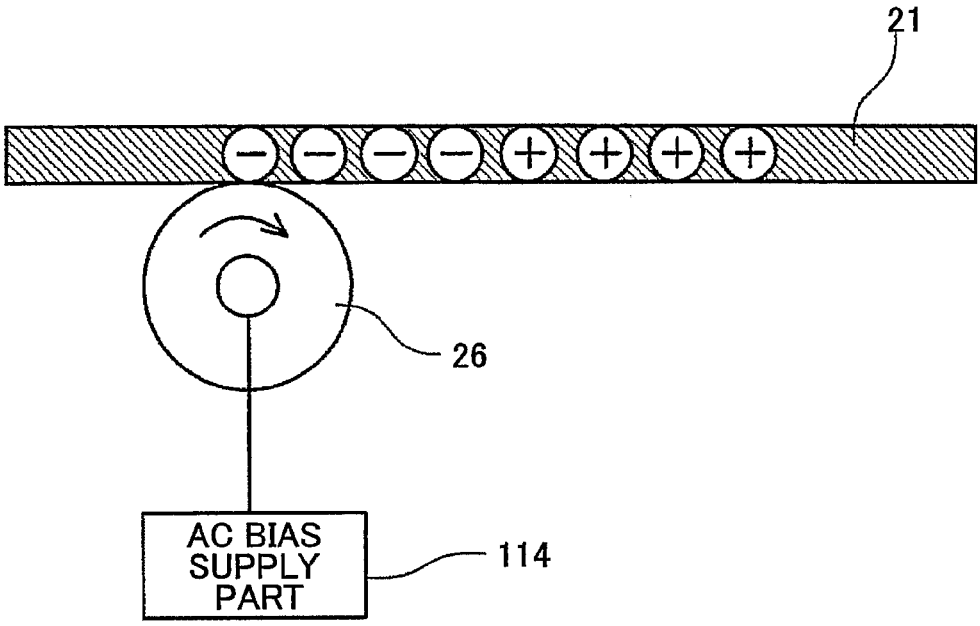
FIG. 4 is a view showing an example of a conveyance belt of the image forming device shown in FIG. 1.
Figure 5:
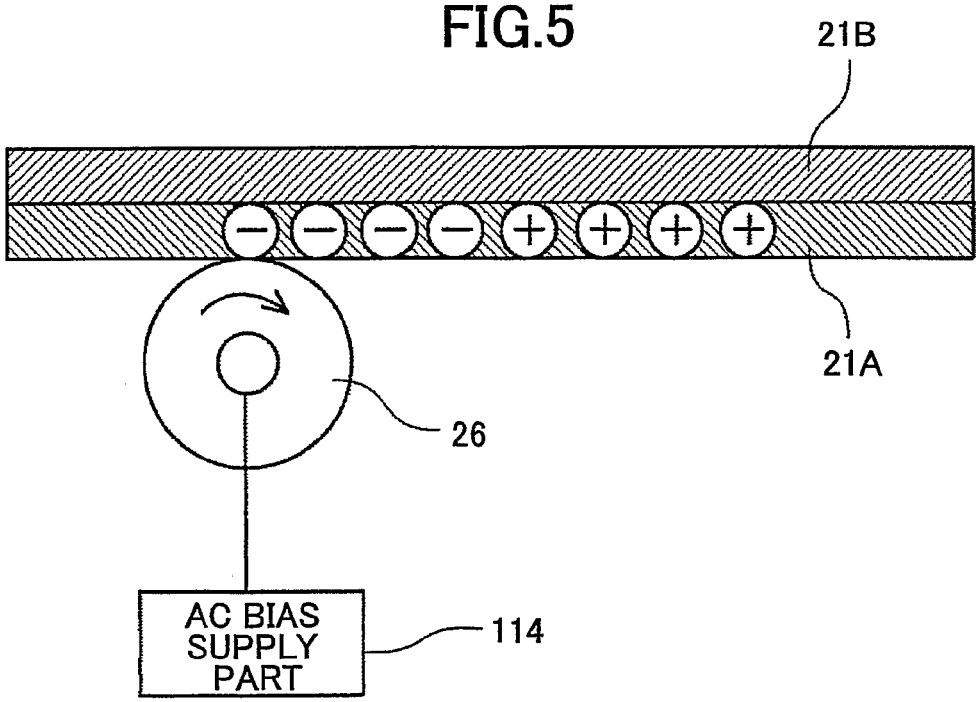
FIG. 5 is a view showing another example of a conveyance belt of the image forming device shown in FIG. 1.

The conveyance belt 21 may be an endless belt having a single-layer structure as shown in FIG. 4. The conveyance belt 21 may be an endless belt having a multi-layers structure as shown in FIG. 5.

In the case of the conveyance belt 21 having the single-layer structure, the entirety of the conveyance belt 21 is formed by an insulation material because the conveyance belt 21 comes in contact with the paper 12 or the electrostatic charging roller 26.

In the case of the conveyance belt 21 having the multi-layer structure, it is preferable that the side of the conveyance belt 21 where the conveyance belt 21 comes in contact with the paper 12 or the electrostatic charging roller 26 is formed by an insulation layer 21A and the side of the conveyance belt 21 where the conveyance belt 21 does not come in contact with the paper 12 or the electrostatic charging roller 26 is formed by a conductive layer 21B.

It is preferable that an insulation layer forming the conveyance belt 21 having the single layer structure or forming the conveyance belt 21 having the multi-layer structure be resin such as PET, PEI, PVDF, PC, ETFE, or PTFE or an elastomer not including a conductive control material.

It is also preferable that the insulation layer have a volume resistivity equal to or greater than $10^{12}$ [Ωcm]. More preferably, the insulation layer has a volume resistivity of $10^{15}$ [Ωcm].

It is also preferable that the conductive layer 21B of the conveyance belt 21 having the multi-layer structure be made of the same resin or elastomer including carbon, and the volume resistivity of the conductive layer 21B be $10^5$ through $10^7$ [Ωcm].

The electrostatic charging roller 26 comes in contact with the insulation layer 21A being a surface layer of the conveyance belt 21 in the case of a multi-layer belt and is rotated by the rotation of the conveyance belt 21. The electrostatic charging roller 26 has force applied to both ends of a shaft.

The electrostatic charging roller 26 is formed by a conductive member having a volume resistivity of $10^6$ through $10^9$ [Ωcm]. An AC bias supply part 114 configured to apply, for example, AC bias of ±2 kV to the electrostatic charging roller 26 is connected to the electrostatic charging roller 26. The AC bias applied to the electrostatic charging roller 26 may have various wave shapes such as a sine wave or a delta wave. However, it is preferable that the AC bias have a square wave.

Figure 3:
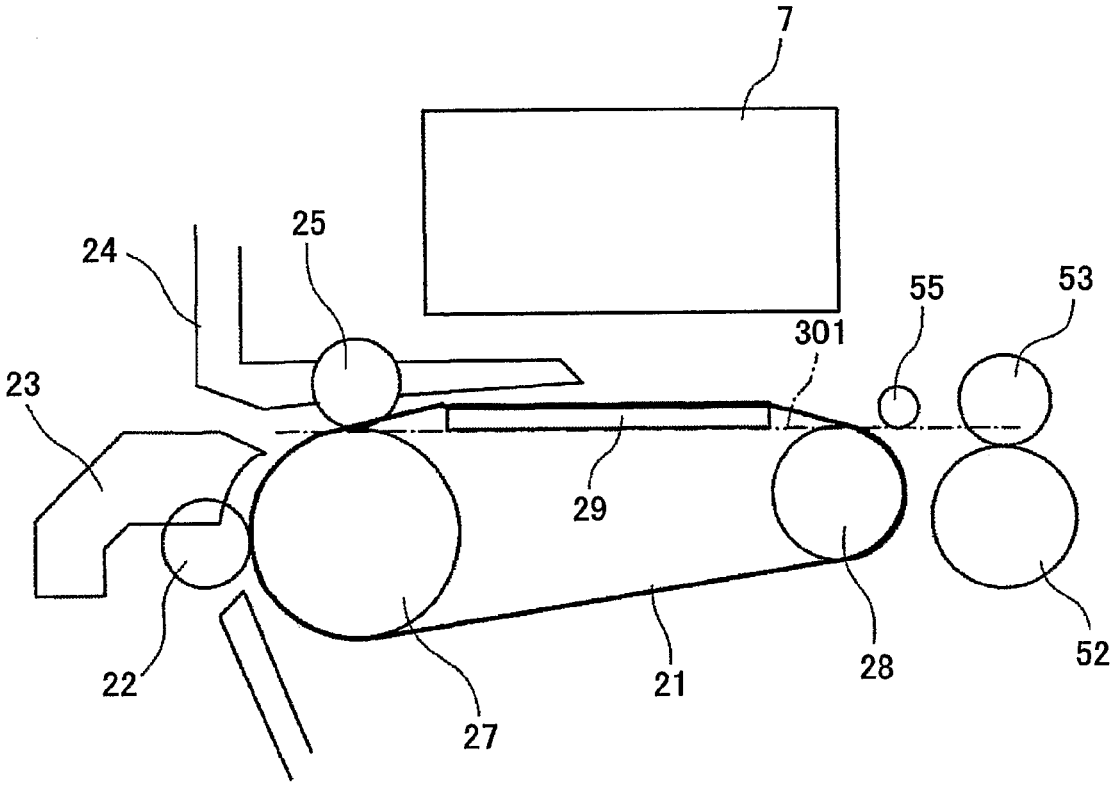
FIG. 3 is an expanded side view of the main part of the image forming device shown in FIG. 1.

As shown in FIG. 3, the upper surface of the guide member is mounted in a state to project to the recording head 7 side with respect to the tangent line between the rollers 27 and 28 so that flatness of plane surface of the conveyance belt 21 can be secured with high precision.

In addition, as shown in FIG. 2, a slit disk 34 is provided at a shaft of the conveyance roller 27. A sensor 35 configured to detect the slits of the slit disk 34 and the slit disk 34 form an encoder 36.

As shown in FIG. 1, an encoder scale 42 having a slit is provided at a front side of the carriage 3. An encoder sensor 43 being a transmission type photo sensor configured to detect the slit of the encoder scale 42 is provided at the front surface side of the carriage 3. The encoder scale 42 and the encoder sensor 43 form an encoder configured to detect a main scanning direction position of the carriage 3.

As a paper discharge part configured to discharge the paper 12 recorded on by the recording head 7, there are a separation claw 51, paper discharge rollers 52 and 53 and a paper discharge tray 54. The separation claw 51 separates the paper 12 from the conveyance belt 21.

The paper discharge roller 53 is a spur roller having a star-shaped cross-section. The discharged papers 12 are stacked in the paper discharge tray 54. Although details are discussed below, a spur 55 is provided so as to face the tension roller 28 and press the printed paper 12 conveyed to the paper discharge part by the conveyance belt 21.

A both sides paper feeding unit 61 is detachably provided at a rear side. The both sides paper feeding unit 61 takes in the paper 12 returned by a reverse rotation of the conveyance belt 21 and reverses the paper 12 so as to feed the paper 12 again between the counter roller 22 and the conveyance belt 21.

In addition, an extension tray 70 can be attached at a bottom part of the image forming device, as well as the paper feeding tray 10, a pressure plate (paper stacking part) 71 where the papers are stacked, a paper feeding roller 73, and a separation pad 72.

In a case of paper feeding, the paper feeding roller 73 and the separation pad 72 separate and feed the papers 12 one by one and the conveyance rollers 75 and 76 send the paper from a lower part of the device main part to a space between the counter roller 22 and the conveyance belt 21.

A surface resistance meter 80 is provided in a paper feeding path of the paper 12, more specifically at a side in the main scanning direction of the paper feeding roller 13, so that a surface resistivity of the fed paper 12 is measured.

In the image forming device having the above-discussed structure, the papers 12 are separated and fed from the paper discharge part one by one. The paper 12 fed to the upper part in a substantially vertical direction is guided by the guide 15 and clamped and conveyed by the conveyance belt 21 and the counter roller 22.

In addition, the head end of the paper 12 is guided by the conveyance guide 23. The paper 12 is pressed to the conveyance belt 21 by the head end pressing roller 25 and the conveyance direction of the paper 12 is changed by substantially 90 degrees.

At this time, a positive output and a negative output are alternately and repeatedly applied to the charging roller 26. In other words, an alternating voltage is applied so that positive and negative electrical charges are applied to the conveyance belt 21 in a rotation direction, namely a sub scanning direction, forming belts at a designated width.

When the paper 12 is fed on the conveyance belt 21 that has alternately charged positive and negative belts, the paper 12 is adhered to the conveyance belt 21 by the electrostatic force. The paper 12 is conveyed in the sub-scanning direction by rotational moving of the conveyance belt 21.

Ink drops of a single line are jetted to the stopped paper 12 for recording by driving the recording head 7 corresponding to the image signal while the carriage 3 is moved in the main scanning direction.

After the paper 12 is conveyed at a designated length, recording for next line is performed. A recording finishing signal or a signal indicating that a rear end of the paper 12 reaches a recording area is received, so that the recording operation is finished and the paper 12 is discharged to the paper discharge tray 54.

In a case of the both sides printing, when recording on a first surface is completed, the conveyance belt 21 is reverse-rotated so that the paper where recording is completed is sent in the both sides paper feeding unit 61. The paper 12 is reversed so that a second surface is now a printing surface and the paper 12 is fed again between the counter roller 22 and the conveyance belt 21.

The timing control is performed and the paper 12 is conveyed on the conveyance belt 21 for printing the rear surface (second surface) and then the paper 12 is discharged to the paper discharge tray 54.

Figure 6:
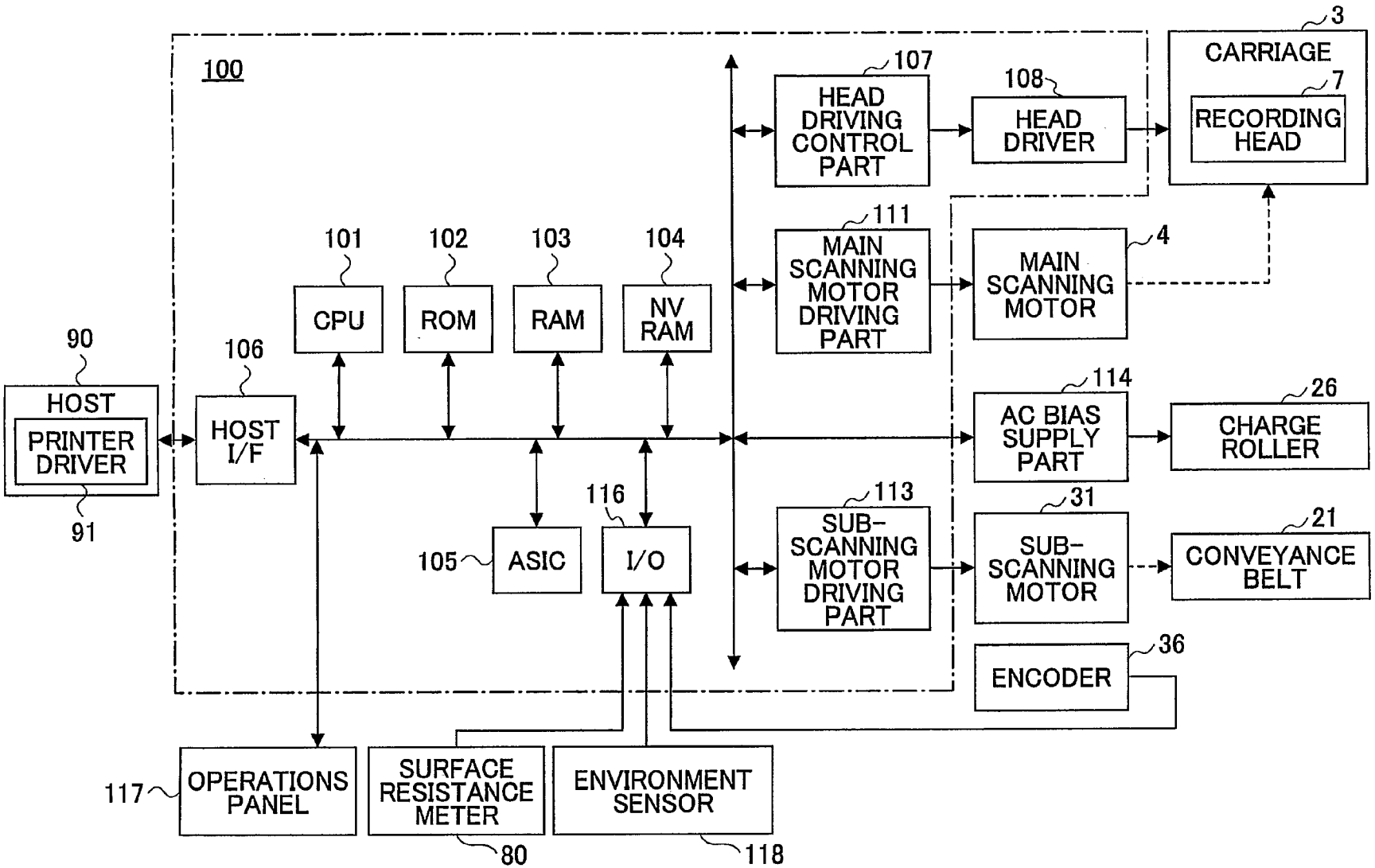
FIG. 6 is a block diagram for explaining a schematic structure of a control part of the image forming device shown in FIG. 1.

Next, a control part of this image forming apparatus is discussed with reference to FIG. 6. Here, FIG. 6 is a block diagram for explaining a schematic structure of the control part of the image forming device shown in FIG. 1.

This control part 100 includes a CPU 101, a ROM 102, a RAM 103, a nonvolatile memory 104, and an ASIC 105.

The CPU 101 controls the entirety of the image forming device. A program performed by the CPU 101 and other fixed data are stored in the ROM 102. Image data and others are stored in the RAM 103 for a time. The nonvolatile memory 104 is rewritable so that the data are stored even when the electric power of the device is cut off. The ASIC 105 performs various signal processing of the image data, image processing for changing the arrangement of the data, and processing of input/output signals for controlling the entirety of the device.

This control part 100 also includes an I/F 106, head driving parts 107 and 108, a main scanning motor driving part 111, a sub-scanning motor driving part 113, an environmental sensor 118, an I/O 116, and others.

The I/F 106 transmits and receives data or a signal to and from a host 90 that is a data processing device such as a personal computer. The head driving control parts 107 and 108 perform driving control of the recording head 7. The main scanning motor driving part 111 drives the main scanning motor 4. The sub-scanning motor driving part 113 drives the sub-scanning motor 31.

The environmental sensor 118 detects the environmental temperature and moisture via the encoder 36. The I/O 116 inputs a detection signal from various kinds of sensors such as a surface resistance meter 80 detecting the surface resistance value of the recording medium or the encoder 44.

An operations panel 117 is connected to the control part 100. The operations panel 117 is used for inputting and displaying information necessary for this device. In addition, the control part 100 controls turning on or off of output of the AC bias supply part (high voltage power supply) 114 configured to apply the AC bias to the charging roller 26.

The control part 100 receives printing data including image data from the host 90 via a cable or network by the I/F 106. Here, the host 90 corresponds to a data processing device such as a personal computer, an image reading device such as an image scanner, a photographing device such as a digital camera, and others. An output of the printing data to the control part 100 is performed by the printer driver 91 at the host 90.

The CPU 101 reads and analyzes the printing data in a receiving buffer included in the I/F 106 and performs the process of changing the arrangement of the data by using the ASIC 105 so as to transfer the image data to the head driving control part 107.

While the conversion of the printing data for image outputting to bit map data is transferred to this device by developing the image data to the bit map data by the printer driver 91 at the host 90 side in this example, the conversion of the printing data for image outputting to the bit map data may be performed by storing the font data in the RAM, for example.

When receiving the image data (dot pattern data) corresponding to a single line of the recording head 7, the head driving control part 107 synchronizes the dot pattern data of the single line to the clock signal so as to send the serial data to the head driver 108 and send a latch signal to the head driver 108 at a designated timing.

This head driving control part 107 includes a ROM (which may be the ROM 102) storing pattern data of a driving wave form (driving signal) and a driving waveform generation circuit including an amplifier and a waveform generation circuit including a D/A converter configured to perform D/A conversion of driving waveform data read by this ROM.

The head driver 108 includes a shift register, a latch circuit, a level conversion circuit (level shifter), an analog switch array (switch means), and others.

The shift register inputs a clock signal from the head driving control part 107 and serial image data. The latch circuit latches the register value of the shift register by the latch signal from the head driving control part 107. The level conversion circuit performs a level change of an output value of the latch circuit. The level shifter controls turning on or off of the analog switch array.

The head driver 108 controls turning on or off of the analog switch array so that the designated driving wave form included in the driving waveforms is selectively applied in the actuator part of the recording head 14 so that the recording head 14 is driven.

The main scanning motor driving part 111 calculates a control value based on an object value received from the CPU 101 and a speed detection value obtained by sampling the detection pulse from the encoder 44 so as to drive the main scanning motor 4 via an inside motor driver.

Similarly, the sub-scanning motor driving part 113 calculates a control value based on an object value received from the CPU 101 and a speed detection value obtained by sampling the detection pulse from the encoder 36 so as to drive the sub-scanning motor 31 via an inside motor driver.

Figure 7:
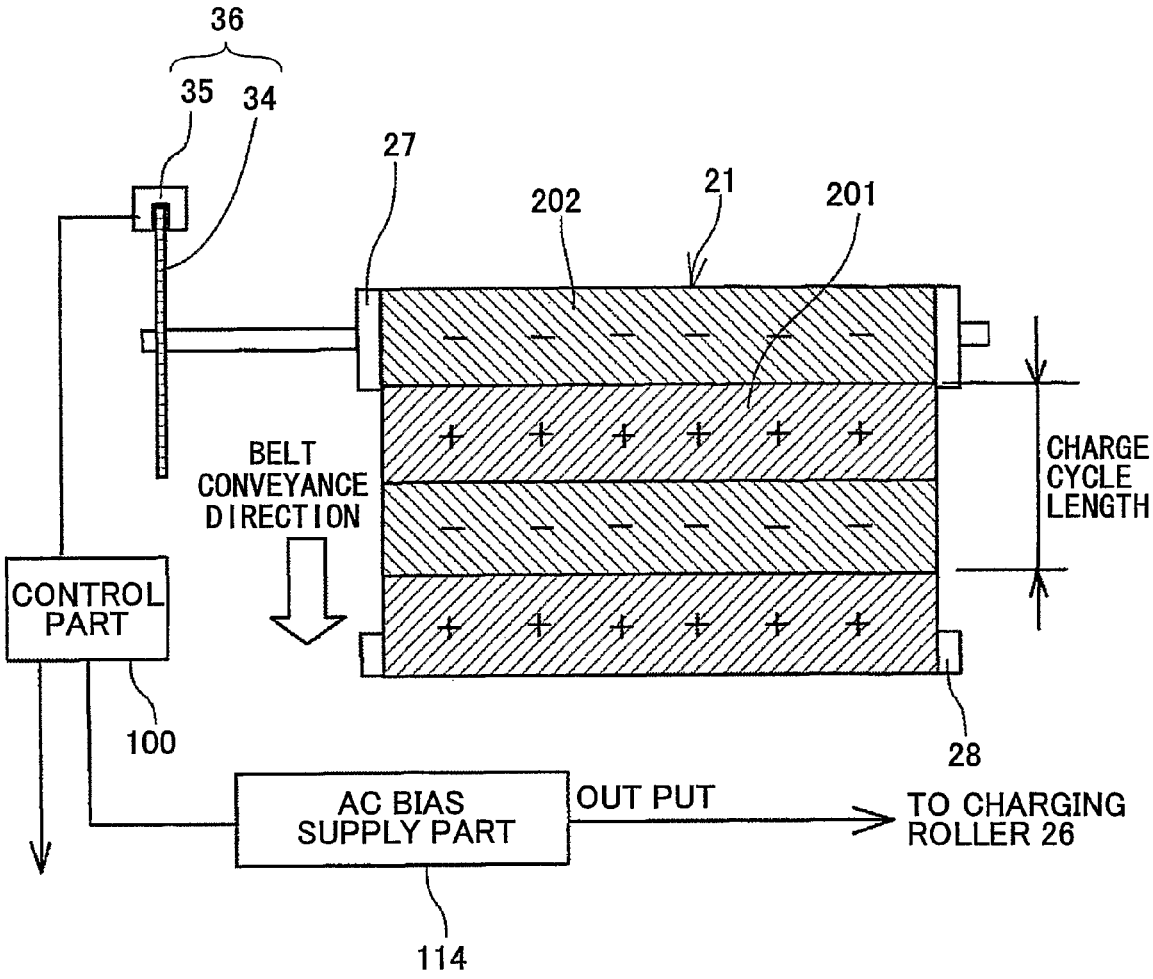
FIG. 7 is a schematic view of a part related to electrostatic charging control of the image forming device shown in FIG. 1.

Electrostatic charge control of the conveyance belt 21 in this image forming device is discussed with reference to FIG. 7 and others. Here, FIG. 7 is a schematic view of a part related to electrostatic charging control of the image forming device shown in FIG. 1.

As discussed above, the amount of rotation is detected by the encoder 36 provided at an end part of the conveyance roller 27 driving the conveyance belt 21. As corresponding to the detected rotation amount, the sub-scanning motor 31 is drive-controlled by the sub-scanning motor driving part 113 of the control part 100 and output of the AC bias supply part (high voltage power supply) 114 applying a high voltage (AC bias) to the charging roller 26 is controlled.

The AC bias supply part 114 controls a cycle (application time) of positive and negative voltages applied to the charging roller 26 and simultaneously the control part 100 controls driving of the conveyance belt 21, so that positive and negative electrical charges can be applied to the conveyance belt 21 at a designated charging cycle length. Here, the "charging cycle length" means a width (length) in a conveyance direction per one cycle of positive and negative application voltages as shown in FIG. 7.

As discussed above, when printing starts, the conveyance roller 27 is rotated by the sub-scanning motor 31 so that the conveyance belt 21 moves clockwise in FIG. 1. Simultaneously, positive and negative square waves are applied from the AC bias supply part 114 to the charging roller 26.

Figure 8:
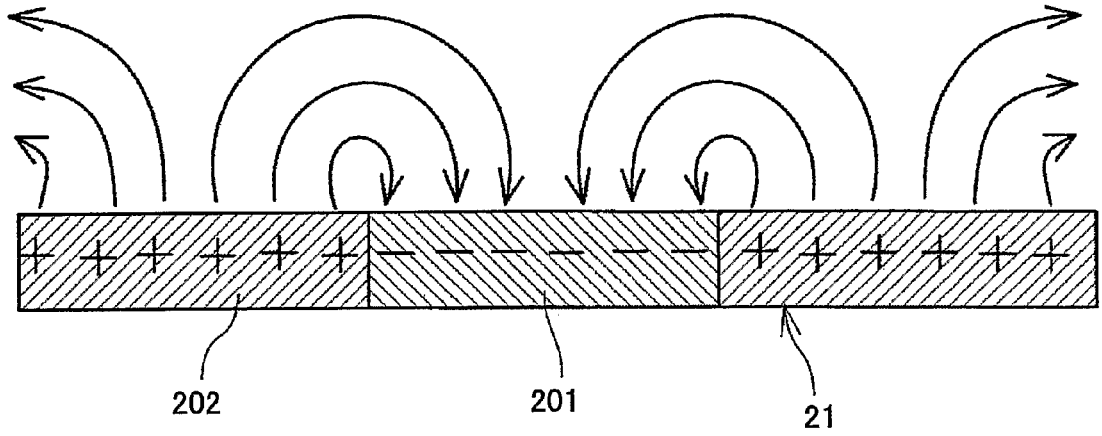
FIG. 8 is a schematic view for explaining that the conveyance belt is electrostatically charged.

As a result of this, since the charging roller 26 comes in contact with the insulation layer 21A of the conveyance belt 21, as shown in FIG. 7, positive and negative electrical charges are mutually applied in the conveyance direction of the conveyance belt 21 to the insulation layer 21A of the conveyance belt 21 so that belt shape positive charging area 201 and negative charging area 202 are mutually formed. As a result of this, as shown in FIG. 8, a non-uniform electrical field is generated on the conveyance belt 21.

As discussed above, it is also preferable that the insulation layer 21A of the conveyance belt 21 where the positive and negative electrical charges are applied have a volume resistivity equal to or greater than $10^{12}$ [Ωcm]. More preferably, the insulation layer has a volume resistivity of $10^{15}$ [Ωcm]. Hence, it is possible to prevent the positive and negative electrical charges from moving at a boundary so that the positive and negative electrical charges applied to the insulation layer 21A can be held.

Each of the papers 12 is separated by the paper feeding roller 13 and the separation pad 14. The paper 12 is conveyed to the conveyance belt 21 where the non-uniform electrical field is generated due to the formation of the positive and negative electrical charges at the insulation film 21A. The paper 12 conveyed on the non-uniform electrical field is polarized immediately along the direction of the electrical field.

Figure 9:
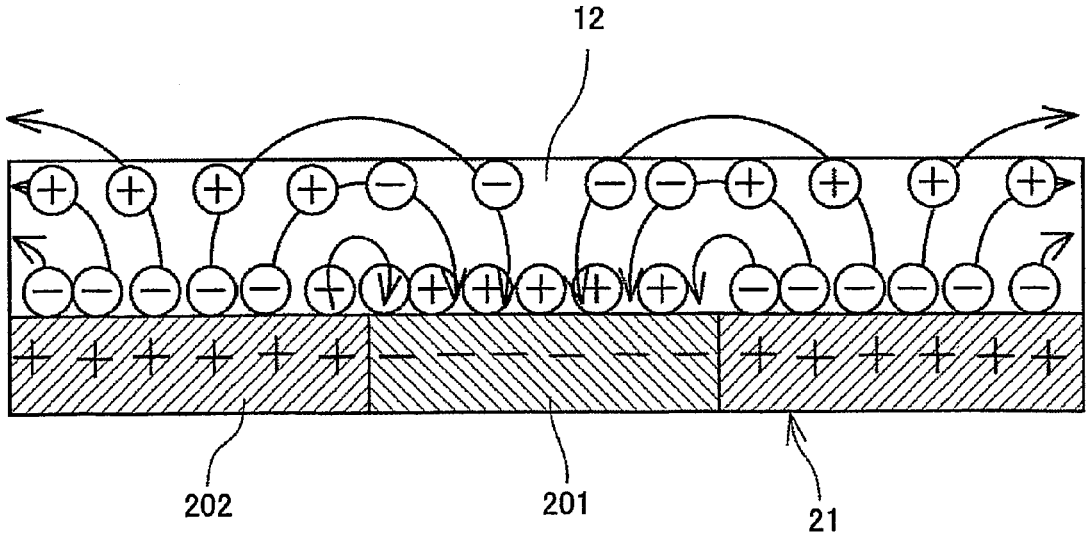
FIG. 9 is a schematic view for explaining the paper coming in contact with the conveyance belt.

As shown in FIG. 9, the electrical charge causing an attracting force of the conveyance belt is dense due to the non-uniform electrical field. The electrical charge causing a repulsion force on the conveyance belt 21 appearing at the opposite side is non-dense.

The paper 12 is immediately adhered to the conveyance belt 21 due to the difference of the electrical charges. In addition, since the paper 12 has limited resistance, a true charge is induced at the adhering surface and opposite side of the paper 12.

The positive and negative true electrical charges induced at the adhering surface side of the paper 12 and the electrical charges applied on the conveyance belt 21 pull against each other so that a stable attraction force can be made.

Furthermore, the paper 12 has a limited surface resistivity of $10^{7}$ [Ω] through $10^{13}$ [Ω]. Hence, the true electrical charge induced at the adhesion side and the opposite side of the paper 12 can move and neighboring positive and negative electrical charges pull against each other as time passes so that neutralizing occurs and the number of the electrical charges is decreased.

As a result of this, the electrical charges on the conveyance belt 21 are balanced with the true electrical charges induced at the adhering surface side of the paper 12 so that the electrical field is closed. As discussed above, the true electrical charges induced at a side opposite to the adhering surface of the paper 12 are neutralized so that the electrical field is closed. In other words, the electrical field toward the recording head 7 is reduced.

In addition, since the electrical charge applied on the surface of the conveyance belt 21 and the electrical charge having a non-dense relationship with the electrical charge of the conveyance belt 21 are reduced away from the surface of the paper 12, the attraction force of the paper 12 to the conveyance belt 21 is increased as time passes.

As discussed above, the paper 12 adhered by the conveyance belt 12 is conveyed below the recording head 7, the carriage 3 reciprocates in a main scanning direction, and simultaneously ink liquid drops are jetted from the recording head 7, so that the image is formed on the paper 12 by reciprocating movement of the recording head 7.

After the image is formed on the paper 12 by reciprocating movement of the recording head 7, the paper 12 is sent to next printing position by the conveyance belt 21 and the image is formed again by reciprocating movement of the recording head 7. The paper 12 is separated from the conveyance belt 21 by the separation claw 51 so as to be discharged to the paper discharge tray 54.

Figures 10, 11:
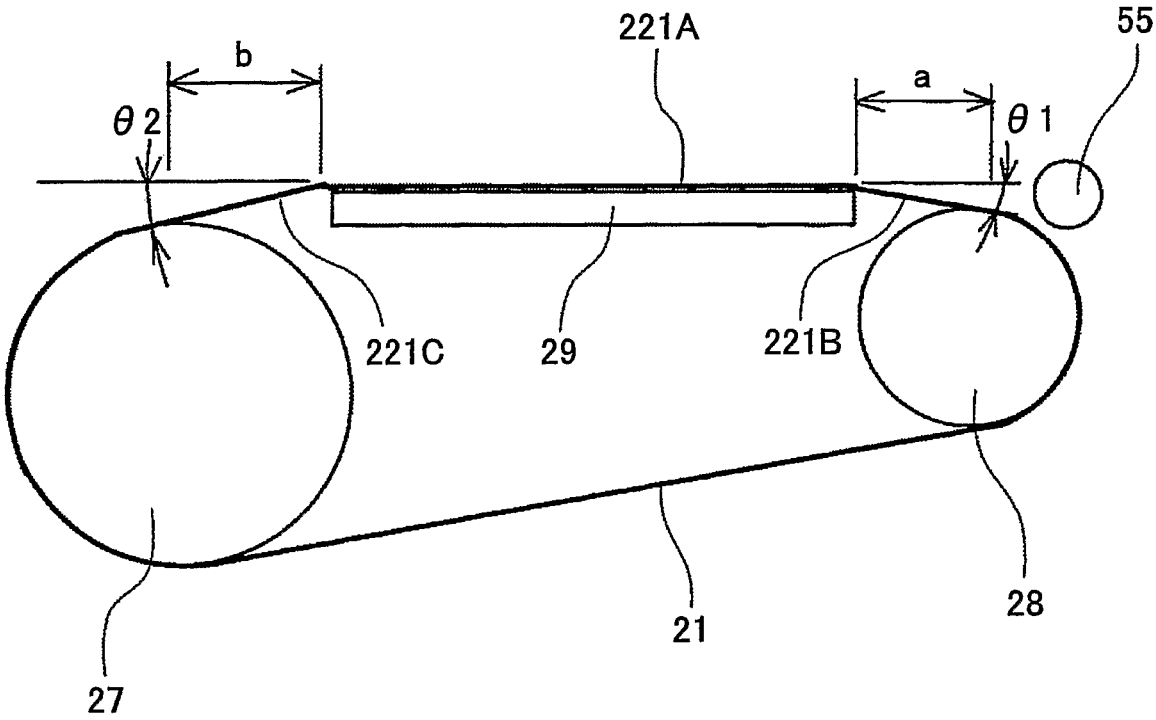
FIG. 10 is an expanded side view of a conveyance belt unit part.
FIG. 11 is a table for explaining the relationship between a printing mode and the result of measurement of attraction of the paper by the conveyance belt.

Next, details of the conveyance unit are discussed with reference to FIG. 10. Here, FIG. 10 is an expanded side view of a conveyance belt unit part.

As discussed above, the conveyance unit includes the conveyance belt 21, the conveyance guide plate 29, and the electrical charging roller 26.

The conveyance belt 21 is tensioned between the conveyance roller (belt driving roller) 27 and the tension roller 28.

The conveyance guide plate 29 is provided in a printing area facing the recording head 7 inside of the conveyance belt 21. The conveyance guide plate 29 guides the conveyance belt 21 from the inside as a guide part or guide means.

The electrical charging roller 26 charges the conveyance belt 21 for electrostatically charging the paper 12 to adhere to the conveyance belt 21 for conveying, as a charging part or charging means. More specifically, in this example, the electrical charging roller 26 charges the insulation layer 21A being a surface layer of the conveyance belt 21.

The conveyance guide plate 29 is mounted in a state to project to the recording head 7 side with respect to the tangent line between the rollers 27 and 28 so that flatness of plane surface 221A of the conveyance belt 21 is secured in the area of the conveyance guide plate 29. The tilt surface 221B is tilted downward in an area separated from the conveyance guide plate 29 and toward the tension roller 28.

Thus, when the conveyance guide plate 29 is provided so that the flatness, of plane surface of the conveyance belt 21 is secured in the printing area facing the recording head 7, the tilt surface 221B is tilted downward in an area separated from the conveyance guide plate 29 and toward the tension roller 28. As a result of this, the paper 12 electrostatically adhered to the conveyance belt 12 is separated from the conveyance belt 12 and the electrostatic attraction force becomes zero. Hence, the paper 12 is immediately separated even from a part of the recording head 7.

Because of this, in this embodiment, the relationship between the tension roller 28 and the conveyance guide plate 29 is that the recording medium 12 adhered to the conveyance belt 21 by the electrostatic force is not separated from the conveyance belt 21 at an angle θ1 formed by the flat surface of the conveyance belt 21 facing the recording head 7 and the tilt surface 221B tilted downward in a downstream side of the recording head 7.

The inventors of the present invention examined this angle θ1 in detail.

First, as discussed above, the alternate electric charges were applied so that the paper 12 is adhered on the conveyance belt 12. The attraction forces in a case of single side printing and of a second surface in a case of both sides printing were measured. As shown in FIG. 11, 10 N was measured as the attraction force in the case of the single side printing, and 5 N was measured due to the moisture of the ink in the first surface as the attraction force in the case of the both sides printing.

Because of this, the single side printing and the both sides printing are performed by changing the angle θ1 and the angle at which the paper is not separated from the conveyance belt 21 is evaluated. The results of this are shown in FIG. 12 (in the case of the single side printing) and FIG. 13 (in the case of the both sides printing).

According to the result shown in FIG. 12, in the case of the single side printing, if the angle θ1 formed by the flat surface of the conveyance belt 21 facing the recording head 7 and the tilt surface 221B tilted downward in a downstream side of the recording head 7 is greater than 5 degrees, the paper 12 is separated from the conveyance belt 21.

On the other hand, according to the result shown in FIG. 13, in the case of the both sides printing, as discussed above, when the second surface is printed, the attraction force is reduced due to the moisture in the ink in the first surface. Hence, if the angle θ1 formed by the flat surface of the conveyance belt 21 facing the recording head 7 and the tilt surface 221B tilted downward in a downstream side of the recording head 7 is greater than 3 degrees, the paper 12 is separated from the conveyance belt 21.

Accordingly, in a case where only single side printing is performed, in other words, in a case of an image forming device not having the both sides (surfaces) unit, it is preferable that the position relationship between the conveyance guide plate 29 and the tension roller 28 be set so that the angle θ1 does not exceed 5 degrees.

As a result of this, the paper 12 can be conveyed to the paper discharge part by preventing the paper from being separated at the tilt surface 221B of the conveyance belt 21 so that a high quality image can be stably formed.

In addition, in a case of the image forming device having the both sides unit whereby the both sides printing can be performed, it is preferable that the position relationship between the conveyance guide plate 29 and the tension roller 28 be set so that the angle θ1 does not exceed 3 degrees. As a result of this, the paper 12 can be conveyed to the paper discharge part by preventing the paper from being separated at the tilt surface 221B of the conveyance belt 21 so that a high quality image can be stably formed.

The inventors of the present invention found through the experiment that the separation of the paper 12 at the tilt surface 221B of the conveyance belt 21 is related to not only the angle θ1 but also the length a in an extending direction of the flat surface 221A of the tilt surface 221B shown in FIG. 10.

Because of this, the single side printing and the both sides printing are performed by changing the length a so that a length at which the paper 12 is not separated from the conveyance belt 21 is evaluated. The results of this are shown in FIG. 14 (in the case of the single side printing) and FIG. 15 (in the case of the both sides printing).

According to the result shown in FIG. 14, in the case of the single side printing, if the angle θ1 formed by the flat surface of the conveyance belt 21 facing the recording head 7 and the tilt surface 221B tilted downward in a downstream side of the recording head 7 is greater than 5 degrees, the paper 12 is separated from the conveyance belt 21.

On the other hand, according to the result shown in FIG. 15, in the case of the both sides printing, as discussed above, when the second surface is printed, the attraction force is reduced due to the moisture in the ink in the first surface. Hence, if the angle θ1 formed by the flat surface of the conveyance belt 21 facing the recording head 7 and the tilt surface 221B tilted downward in a downstream side of the recording head 7 is greater than 3 degrees, the paper 12 is separated from the conveyance belt 21.

Accordingly, in a case where only a single side printing is performed, in other words, in a case of an image forming device not having the both sides (surfaces) unit, it is preferable that the position relationship between the conveyance guide plate 29 and the tension roller 28 be set so that the angle θ1 does not exceed 5 degrees. As a result of this, the separation of the paper 12 at the tilt surface 221B of the conveyance belt 21 is prevented.

It is preferable that the above-discussed angle θ1 be smaller than an angle θ2 formed by the flat surface 221A of the conveyance belt 21 facing the recording head 7 and the tilt surface 221C tilted downward in an upstream side of the recording head 7 ($\theta 1<\theta 2$). In this case, the paper 12 can be pressed by a pressing roller at the tilt surface 221*c* side. Even if there is some angles at the tilt surface 221C side, it is possible to forcibly press the paper 12 to the conveyance belt 21.

Next, when the ink drop is adhered to the paper 12, the paper 12 is expanded due to the moisture so that the paper waviness is generated in a direction crossing the paper feeding direction. If the paper waviness reaches to the recording head 7, the printed image may be damaged due to abrasion of the recording head 7 and the paper 12.

Because of this, the length a of the surface where the conveyance belt 21 at the downstream side of the plane surface of the conveyance guide plate 29 shown in FIG. 10 is formed is changed so that the relationship between the length a and the abrasion of the recording head with the paper where a designated amount of ink (maximum amount of standard amount of the ink in this case) are printed is measured. The result of this is shown in FIG. 14 and FIG. 15.

Through these results, it is found that there is a relationship between the expansion due to the moisture of the paper and an adhesion area of the paper. In this example, in the singe side printing, the attraction force is 10 N (See FIG. 10.) and the length a at which the abrasion between the recording head 7 and the paper due to the expansion of the paper due to the moisture is not generated is equal to or greater than 10 mm.

By setting this length a, in a case of the image forming device for only the single side printing, the paper waviness of the recording medium is prevented from reaching to the plane surface of the conveyance guide plate 29 so that a high quality image can be stably formed.

On the other hand, in the case of the both sides printing, the attraction force is 5 N due to the moisture in the ink in the first surface and the length a at which the abrasion between the recording head 7 and the paper is not generated is equal to or greater than 12 mm.

By setting this length a, in a case of the image forming device where both sides printing can be performed, the paper waviness of the recording medium is prevented from reaching the plane surface of the conveyance guide plate 29 so that a high quality image can be stably formed. It is preferable that the maximum value of the length a be equal to or less than 100 mm.

Figure 16:
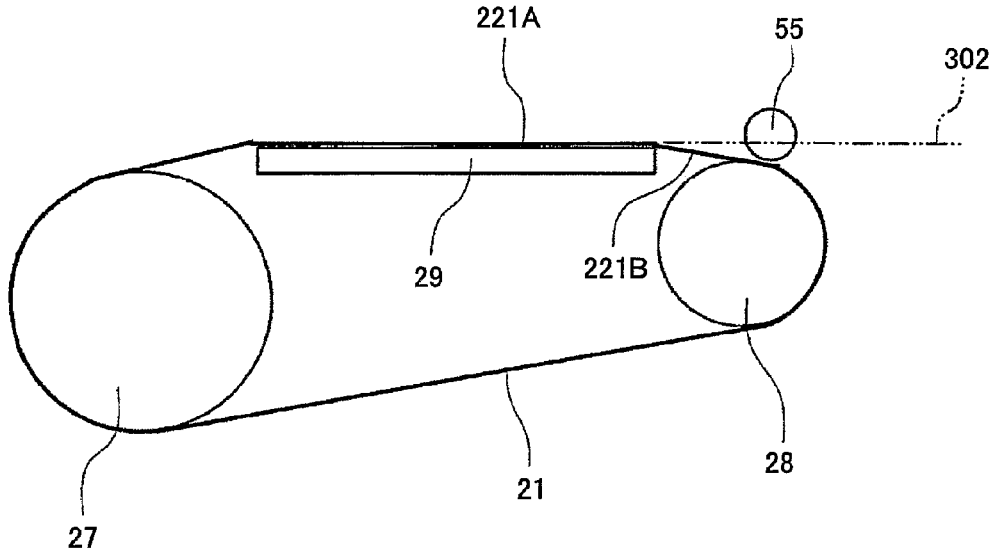
FIG. 16 is an expanded side view of a main part for explaining an example of an arranged position of a spur.

Next, another embodiment where the paper is prevented from being separated from the conveyance belt is discussed with reference to FIG. 16. Here, FIG. 16 is an expanded side view of a main part of the conveyance belt unit.

As discussed above, when the flat surface 221A of the conveyance belt 21 facing the recording head 7 and the tilt surface 221B of the conveyance belt 21 tilted downward at the downstream side of the recording head 7 are formed, the spur 55 is provided so as to press the paper conveyed to a position lower than the extended line 302 of the flat surface 221A of the conveyance belt.

By providing the spur 55 configured to press the paper conveyed to a position lower than the extended line 302 of the flat surface 221A of the conveyance belt, it is possible to prevent the paper 12 conveyed by the conveyance belt 21 from being separated from the flat surface 221A of the conveyance belt 21.

In addition, the spur 55 is provided at a position facing the tilt surface 221B of the conveyance belt 21. Because of this, it is possible to prevent the paper 12 from being separated from the tilt surface 221B of the conveyance belt 21. In this case, the paper can be securely pressed so that the separation of the paper can be securely prevented, by facing the spur 55 to the tension roller 28 hanging on the downstream side in the paper conveyance direction of the conveyance belt 21.

Figure 17:
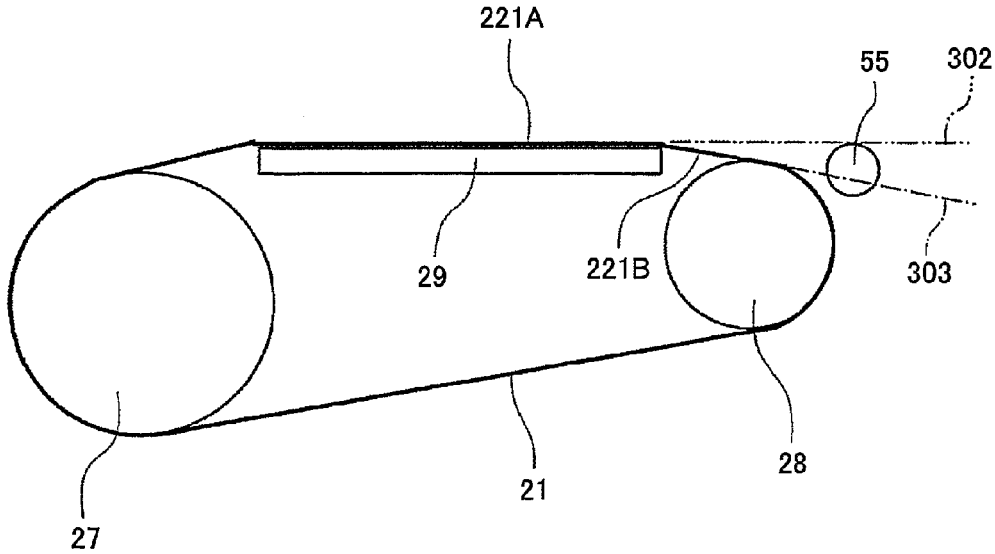
FIG. 17 is an expanded side view of a main part for explaining another example of the arranged position of the spur.

Next, another embodiment where the paper is prevented from being separated from the conveyance belt is discussed with reference to FIG. 17. Here, FIG. 17 is an expanded side view of a main part of the conveyance belt unit.

In this example, as discussed above, the spur 55 is provided so as to press the paper conveyed to a position lower than the extended line 302 of the flat surface 221A of the conveyance belt. As a result of this, it is possible to prevent the paper 12 conveyed by the conveyance belt 21 from being separated from the flat surface 221A of the conveyance belt 21.

In addition, the spur 55 is provided at a position lower than the extended line 303 of the tilt surface 221B of the conveyance belt 21. Under this structure, it is possible to prevent the paper 12 from being separated from the tilt surface 221B of the conveyance belt 21.

Furthermore, by separating the spur 55 from the tilt surface 221B of the conveyance belt 21, it is possible to prevent a hole from being formed in the conveyance belt 21 due to the contact of the spur 55 with the tilt surface 21B of the conveyance belt 21.

Thus, the above-discussed embodiment of the present invention provides an image forming device including: a recording head configured to jet a liquid drop of recording liquid to a recording medium so that an image is formed; and a conveyance belt adhering the recording medium by an electrostatic force; wherein the recording medium adhered to the conveyance belt by the electrostatic force is not separated from the conveyance belt at an angle formed by a flat surface of the conveyance belt facing the recording head and a tilt surface of the conveyance belt tilting downward at a downstream side of the recording head.

The angle formed by the flat surface of the conveyance belt and the tilt surface of the conveyance belt may be less than 5 degrees. The angle formed by the flat surface of the conveyance belt and the tilt surface of the conveyance belt may be less than 3 degrees.

Alternate positive and negative electric charges may be applied on the conveyance belt.

The angle formed by the flat surface of the conveyance belt facing the recording head and the tilt surface of the conveyance belt tilting downward at the downstream side of the recording head may be smaller than an angle formed by a flat surface of the conveyance belt facing the recording head and a tilt surface of the conveyance belt tilting downward at an upstream side of the recording head.

The above-discussed embodiment of the present invention also provides an image forming device, including a recording head configured to jet a liquid drop of recording liquid to a recording medium so that an image is formed; and a conveyance belt adhering the recording medium by an electrostatic force; wherein a flat surface of the conveyance belt facing the recording head and a tilt surface of the conveyance belt tilting downward at a downstream side of the recording head are formed; and waviness of the recording medium does not reach to the flat surface because of a length of the tilt surface.

The length of the tilt surface of the conveyance belt may be equal to or greater than 10 mm and equal to or less than 100 mm. The length of the tilt surface of the conveyance belt may be equal to or greater than 12 mm and equal to or less than 100 mm.

Alternate positive and negative electric charges may be applied on the conveyance belt.

An angle formed by the flat surface of the conveyance belt facing the recording head and the tilt surface of the conveyance belt tilting downward at the downstream side of the recording head may be smaller than an angle formed by a flat surface of the conveyance belt facing the recording head and a tilt surface of the conveyance belt tilting downward at an upstream side of the recording head.

The above-discussed embodiment of the present invention also provides an image forming device, including: a recording head configured to jet a liquid drop of recording liquid to a recording medium so that an image is formed; and a conveyance belt adhering the recording medium by an electrostatic force; wherein a flat surface of the conveyance belt facing the recording head and a tilt surface of the conveyance belt tilting downward at a downstream side of the recording head are formed; and a spur is provided so as to press the recording medium conveyed to a position lower than the flat surface of the conveyance belt.

The spur may be provided at a position facing the tilt surface of the conveyance belt. The spur may be provided at a position lower than an extending line of the tilt surface of the conveyance belt. The spur may be provided at a position facing a roller, the roller winding the conveyance belt at a downstream side in a conveyance direction of the recording medium. The spur may be provided at a position facing a roller, the roller winding the conveyance belt at a downstream side of the recording medium in a conveyance direction.

Alternate positive and negative electric charges may be applied on the conveyance belt.

An angle formed by the flat surface of the conveyance belt facing the recording head and the tilt surface of the conveyance belt tilting downward at the downstream side of the recording head may be smaller than an angle formed by a flat surface of the conveyance belt facing the recording head and a tilt surface of the conveyance belt tilting downward at an upstream side of the recording head.

The present invention is not limited to the above-discussed embodiments, but variations and modifications may be made without departing from the scope of the present invention.

This patent application is based on Japanese Priority Patent Application No. 2005-216253 filed on Jul. 26, 2005, and the entire contents of which are hereby incorporated by reference.

The invention claimed is:

1. An image forming device, comprising:

a recording head configured to jet a liquid drop of recording liquid to a recording medium so that an image is formed;

a conveyance belt adhering the recording medium by an electrostatic force; and a both sides feeding unit detachably provided to the image forming device for forming images on both sides of the recording medium, wherein a flat surface of the conveyance belt facing the recording head and a tilt surface of the conveyance belt tilting downward at a downstream side of the recording head form an angle so that the recording medium adhered to the conveyance belt by the electrostatic force closely contacts the conveyance belt, wherein the angle formed by the flat surface of the conveyance belt and the tilt surface of the conveyance belt is less than 5 degrees when the both sides feeding unit is not operated, and wherein the angle formed by the flat surface of the conveyance belt and the tilt surface of the conveyance belt is less than 3 degrees when the both sides feeding unit is operated.

2. The image forming device as claimed in claim 1, wherein alternate positive and negative electric charges are applied on the conveyance belt.

3. The image forming device as claimed in claim 1, wherein the angle formed by the flat surface of the conveyance belt facing the recording head and the tilt surface of the conveyance belt tilting downward at the downstream side of the recording head is smaller than an angle formed by a flat surface of the conveyance belt facing the recording head and a tilt surface of the conveyance belt tilting downward at an upstream side of the recording head.

4. An image forming device, comprising:

a recording head configured to jet a liquid drop of recording liquid to a recording medium so that an image is formed; and a conveyance belt adhering the recording medium by an electrostatic force;

wherein a flat surface of the conveyance belt facing the recording head and a tilt surface of the conveyance belt tilting downward at a downstream side of the recording head are formed;

first and second rollers are provided in a vicinity of the conveyance belt to discharge the recording medium, said first and second rollers being arranged to sandwich the recording medium; and a spur is provided between the conveyance belt, and the first and second rollers so as to press the recording medium conveyed to a position lower than the flat surface of the conveyance belt.

5. The image forming device according to claim 4, wherein waviness of the recording medium does not reach to the flat surface because of a length of the tilt surface.

6. The image forming device as claimed in claim 5, wherein the length of the tilt surface of the conveyance belt is equal to or greater than 10 mm and equal to or less than 100 mm.

7. The image forming device as claimed in claim 5, wherein the length of the tilt surface of the conveyance belt is equal to or greater than 12 mm and equal to or less than 100 mm.

8. The image forming device as claimed in claim 5, wherein alternate positive and negative electric charges are applied on the conveyance belt.

9. The image forming device as claimed in claim 5, wherein an angle formed by the flat surface of the conveyance belt facing the recording head and the tilt surface of the conveyance belt tilting downward at the downstream side of the recording head is smaller than an angle formed by a flat surface of the conveyance belt facing the recording head and a tilt surface of the conveyance belt tilting downward at an upstream side of the recording head.

10. The image forming device, as claimed in claim 4, wherein the spur is provided at a position facing the tilt surface of the conveyance belt.

11. The image forming device, as claimed in claim 10, wherein the spur is provided at a position facing a roller, the roller winding the conveyance belt at a downstream side in a conveyance direction of the recording medium of the conveyance belt.

12. The image forming device, as claimed in claim 10, wherein the spur provided at the position facing the tilt surface of the conveyance belt prevents the recording medium from being separated from the tilt surface.

13. The image forming device, as claimed in claim 4, wherein the spur is provided at a position lower than an extending line of the tilt surface of the conveyance belt.

14. The image forming device, as claimed in claim 13, wherein the spur is provided at a position facing a roller, the roller winding the conveyance belt a downstream side of the recording medium of the conveyance belt in a conveyance direction.

15. The image forming device as claimed in claim 4, wherein alternate positive and negative electric charges are applied on the conveyance belt.

16. The image forming device as claimed in claim 4, wherein an angle formed by the flat surface of the conveyance belt facing the recording head and the tilt surface of the conveyance belt tilting downward at the downstream side of the recording head is smaller than an angle formed by a flat surface of the conveyance belt facing the recording head and a tilt surface of the conveyance belt tilting downward at an upstream side of the recording head.

17. The image forming device, as claimed in claim 4, wherein the spur provided to press the recording medium to the position lower than the flat surface of the conveyance belt prevents the recording medium conveyed by the conveyance belt from being separated from the flat surface of the conveyance belt.

* * * * *